US009287600B2

(12) United States Patent
Cao et al.

(10) Patent No.: US 9,287,600 B2
(45) Date of Patent: Mar. 15, 2016

(54) ADJUSTABLE PHASE-INVERTING COUPLING LOOP

(71) Applicant: Radio Frequency Systems Pty Ltd., Kilsyth (AU)

(72) Inventors: Yan Cao, Kilsyth (AU); Dieter Pelz, Kilsyth (AU)

(73) Assignee: ALCATEL-LUCENT SHANGHAI BELL CO., LTD., Shanghai (CN)

( * ) Notice: Subject to any disclaimer, the term of this patent is extended or adjusted under 35 U.S.C. 154(b) by 52 days.

(21) Appl. No.: 14/226,232

(22) Filed: Mar. 26, 2014

(65) Prior Publication Data

US 2015/0280297 A1 Oct. 1, 2015

(51) Int. Cl.
*H01P 1/208* (2006.01)

(52) U.S. Cl.
CPC ..... *H01P 1/208* (2013.01)

(58) Field of Classification Search
CPC ..... H01P 1/207; H01P 5/04
USPC ..... 333/206, 207, 212
See application file for complete search history.

(56) References Cited

U.S. PATENT DOCUMENTS 5,608,363 A * 3/1997 Cameron et al. ..... 333/202
7,777,593 B2 * 8/2010 Weitzenberger ..... 333/134

FOREIGN PATENT DOCUMENTS

EP 2482377 B1 3/2014

* cited by examiner

*Primary Examiner* — Stephen E Jones
(74) *Attorney, Agent, or Firm* — Davidson Sheehan LLP

(57) ABSTRACT

A conductor is formed of a first portion to define a first area in a plane that is substantially perpendicular to a first magnetic field direction in a first cavity resonator and a second portion to define a second area in a plane that is substantially perpendicular to a second magnetic field direction in a second cavity resonator. Inductive current generated in the first portion flows in substantially the same direction as current in the second portion. The conductor may be deployed in an aperture between the first and second cavity resonators to couple or cross-couple the first and second cavity resonators. The conductor may also be deployed to couple or cross-couple cavity resonators in a filter implemented in a broadcast- or base station.

12 Claims, 8 Drawing Sheets

ADJUSTABLE PHASE-INVERTING COUPLING LOOP

BACKGROUND

1. Field of the Disclosure

The present disclosure relates generally to cavity resonators and, more particularly, to coupling between cavity resonators.

2. Description of the Related Art

A conventional bandpass filter may be constructed of a plurality of resonators that are coupled (or cross-coupled) by coupling elements. The overall transfer function of the filter is created by the combination of the individual transfer functions of the resonators and the coupling elements. For example, a cavity filter may be implemented as a plurality of interconnected cavity resonators. Cavity resonators produce relatively low surface current densities and consequently have relatively high Q-factors, which indicates that the rate of energy loss in the cavity is small relative to the energy stored in the cavity. Other resonators such as transverse electromagnetic (TEM) mode (coaxial) resonators can produce relatively large surface current densities, particularly when used to filter radiofrequency transmissions at powers above hundreds of Watts. Cavity resonator filters are therefore often selected for high-power applications such as filtering radiofrequency transmissions at powers on the order of tens to hundreds of kilowatts for reasons of transmitter output spectrum control.

BRIEF DESCRIPTION OF THE DRAWINGS

The present disclosure may be better understood, and its numerous features and advantages made apparent to those skilled in the art by referencing the accompanying drawings. The use of the same reference symbols in different drawings indicates similar or identical items.

DETAILED DESCRIPTION

Figure 1:
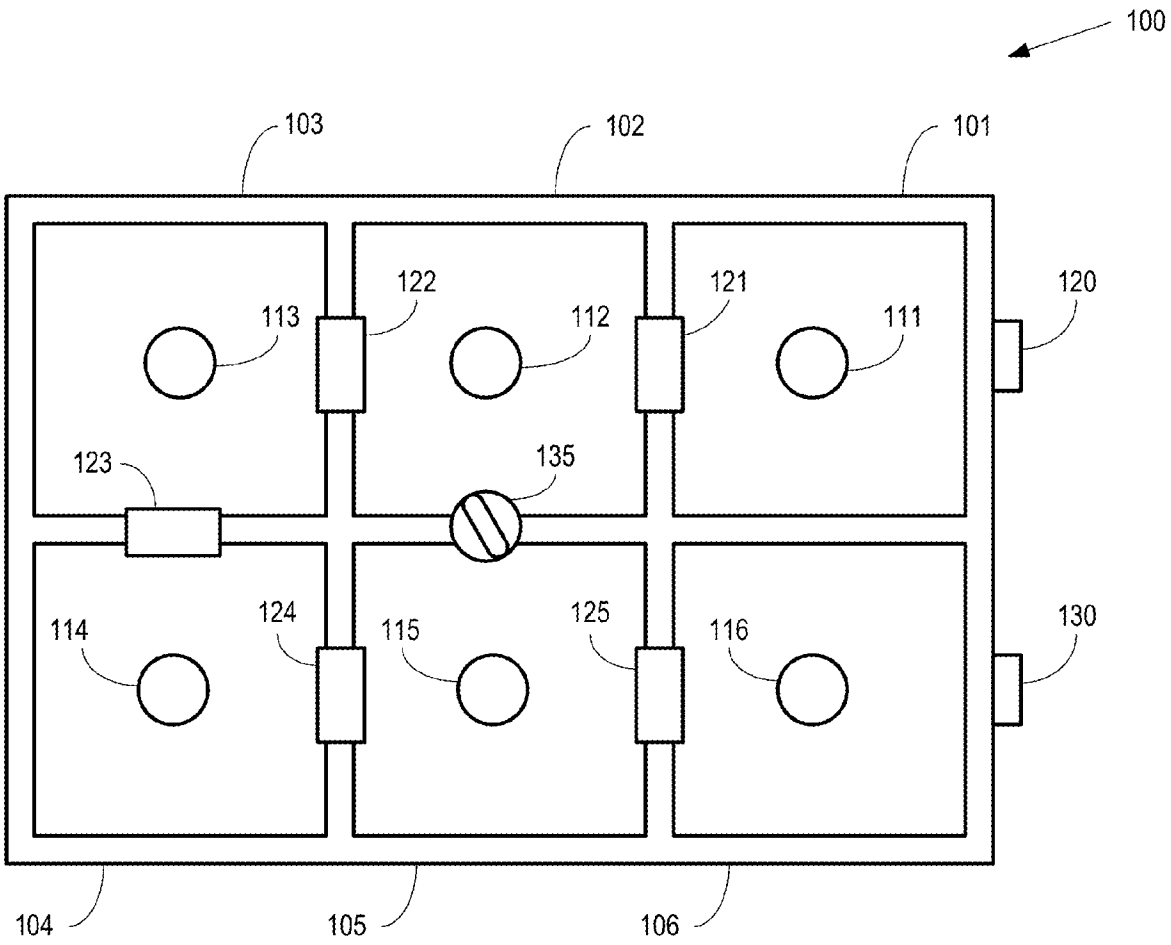
FIG. 1 is a top view of a cross-section of a filter according to some embodiments.

Conventional coupling structures have a number of drawbacks that may limit their suitability for coupling cavity resonators to form a filter. Conventional inductive or magnetic coupling structures often do not provide the correct phase relationships between signals in the coupled cavity resonators when all-inductive couplings are implemented between adjacent resonators. For example, a conventional inductive loop generates a current in one cavity resonator that travels in the opposite direction from the current in the coupled cavity resonator. Conventional inductive coupling structures are therefore not suitable for cross-coupling cavity resonators in a filter. Electric field coupling structures, which may also be referred to as capacitive coupling structures, can be used to cross-couple resonators in an all-inductive filter because the capacitive coupling maintains the correct phase relationships between signals in the coupled resonators and therefore preserves the overall shape of the transfer function of the filter. However, the electromagnetic field distribution within a cavity resonator may become nearly purely magnetic at or near the walls of the cavity resonator. Since there is little or no electric component to the electromagnetic field near the location of the coupling element, conventional electrical or capacitive coupling structures cannot be used to couple (or cross-couple) cavity resonators in the cavity filter.

Cavity resonators may also be used in adjustable or tunable bandpass filters that can be adjusted to filter different frequency ranges that correspond to different selectivity masks. However, conventional coupling structures may not be suitable for use in an adjustable filter of the given type. For example, conventional inductive coupling structures are typically accessible via lids in the filter body and they may have multiple locking points that attach them to the filter body. Each adjustment of the coupling structure therefore requires detaching the multiple locking points, repositioning the coupling structure, and reattaching the multiple locking points. The conventional coupling structures may lack a fine-tuning feature and may require many adjustment iterations to achieve the target filter response. The adjustment process may therefore be difficult, inaccurate, and time-consuming and unsuitable for robotic tuning.

A quasi-capacitive coupling structure can mitigate the drawbacks in conventional coupling structures by coupling the magnetic portions of the electromagnetic fields in neighboring cavity resonators while maintaining the correct phase relations. Some embodiments of the quasi-capacitive coupling structure are formed of a conductor that defines a first area in a plane that is substantially perpendicular to a first magnetic field produced in a first cavity resonator and a second area in a plane that is substantially perpendicular to a second magnetic field produced in a second cavity resonator. Inductive current generated in a first portion of the conductor in the first cavity resonator is conducted into a second portion of the conductor in the second cavity where it generates a corresponding magnetic field, thereby coupling electromagnetic waves in the first and second cavity resonators. The phase of the electromagnetic waves is inverted relative to traditional U-shaped coupling loops, because the current in the first and second conductors flows in the same direction, whereas the currents in cavities coupled by U-shaped coupling loops travel in opposite directions in the different cavities. In some embodiments, the quasi-capacitive coupling structure can be rotatably deployed between the first and second cavity resonators. The coupling strength of the quasi-capacitive coupling structure can replace the conventional U-shaped coupling structures, e.g., as cross-couplings in all-inductive bandpass filters. The single point of adjustment of the S-shaped filter allows embodiments of the quasi-capacitive coupling structure to be adjusted by rotating the quasi-capacitive coupling structure, e.g., using a knob external to a cavity filter that rotates the quasi-capacitive coupling structure.

FIG. 1 is a top view of a cross-section of a filter 100 according to some embodiments. The cross-sectional view is perpendicular to a base plate (not shown in FIG. 1) of the filter 100 and a cover plate (not shown in FIG. 1) of the filter 100 and the cross-section is located within the filter 100 between the base plate and the cover plate. Some embodiments of the filter 100 may be a bandpass filter that is deployed in the receive path or transmit path of a radiofrequency communication system. The radiofrequency communication device may include base stations or access points that transmit, receive, or broadcast radiofrequency signals to user equipment within a wireless communication system. For example, the filter 100 may be used to filter signals that are broadcast by a broadcast station at relatively high power, e.g., at powers near or above 10 kW. Some embodiments of the filter 100 may be tunable or adjustable to selectively filter signals in a frequency range between 400 MHz and 900 MHz. Adjusting the bandwidth of the filter 100 may include changing the center frequency or the filter bandwidth or a selectivity mask.

The filter 100 is formed of six cavity resonators 101, 102, 103, 104, 105, 106 (collectively referred to as "the cavity resonators 101-106"). However, some embodiments of the filter 100 may include more or fewer cavity resonators. Some embodiments of the cavity resonators 101-106 may be implemented as TE-101 mode resonators or transverse electromagnetic wave mode (TEM) resonators. Each of the cavity resonators 101-106 includes a corresponding inner conductor or loading element 111, 112, 113, 114, 115, 116 (collectively referred to as "the loading elements 111-116") that can be adjusted to change the loading, which may be a capacitive loading, in the cavity resonators 101-106, thereby changing the frequency response or transfer function of the cavity resonators 101-106. For example, loading elements 111-116 may be implemented using resonator rods and the depth of the resonator rod into the corresponding cavity resonator 101-106 may determine the capacitive loading. However, other types of loading elements 111-116 may be implemented in the cavity resonators 101-106.

Radiofrequency signals may be introduced into the filter 100 through an input port coupling 120 in the cavity resonator 101. The radiofrequency signals in the cavity resonator 101 may then be transferred into the cavity resonator 102 via a coupling structure 121, into the cavity resonator 103 via a coupling structure 122, into the cavity resonator 104 via a coupling structure 123, into the cavity resonator 105 via a coupling structure 124, and into the cavity resonator 106 via a coupling structure 125. The coupling structures 121-125 may be referred to as direct coupling structures because they couple electromagnetic waves along a direct path from the input port 120, through the cavity resonators 101-106, and out of an output port 130. Some embodiments of the coupling structures 121-125 may be implemented as electrical or capacitive coupling structures in order to suit a chosen coupling scheme for a given filter transfer function response. The filter 100 may be referred to as a "U-shaped" folded filter because the cavity resonators 101-106 are deployed in an arrangement that resembles the letter U. However, some embodiments of the filter 100 may implement other configurations of the cavity resonators 101-106 and more or fewer cavity resonators 101-106 may be deployed to form embodiments of the filter 100.

Some of the cavity resonators 101-106 may be cross-coupled. In some embodiments, any two non-adjacent cavity resonators 101-106 may be cross-coupled. For example, the cavity resonators 102, 105 may be cross-coupled using a quasi-capacitive coupling structure 135. As discussed herein, the quasi-capacitive coupling structure 135 partially encompasses a first area in a plane that is substantially perpendicular to the magnetic field in the cavity resonator 102 and a second portion that partially encompasses a second area in a plane that is substantially perpendicular to the magnetic field in the cavity resonator 105. Inductive currents generated in the first portion of the quasi-capacitive coupling structure 135 flow in substantially the same direction as current in the second portion. The quasi-capacitive coupling structure 135 inverts the phase of radiofrequency signals that are conveyed between the cavity resonator 102 and the cavity resonator 105. Consequently, the quasi-capacitive coupling structure 135 maintains the correct phase relationships between signals in the coupled resonators 102, 105 and preserves the overall shape of the transfer function of the filter 100. Some embodiments of the quasi-capacitive coupling structure 135 can be rotated to adjust its coupling constant. Adjustments to the coupling constant may be performed in coordination with adjusting the frequency response of one or more of the cavity resonators 101-106 to produce a target transfer function of the filter 100.

Figure 2:
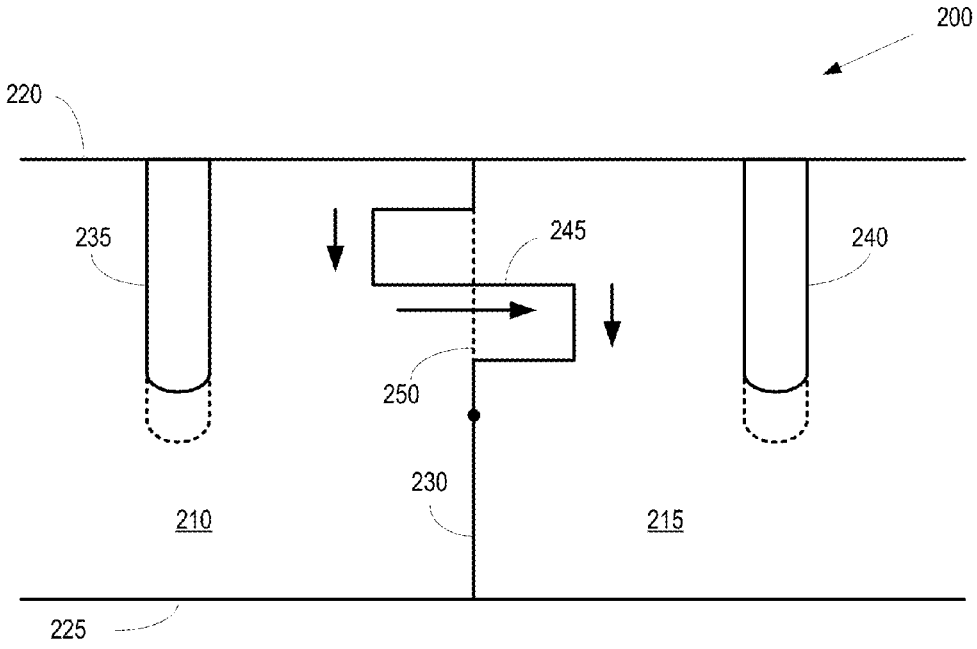
FIG. 2 depicts a quasi-capacitively coupled cavity resonator pair and a corresponding effective electrical equivalent circuit according to some embodiments.
Figure 2:
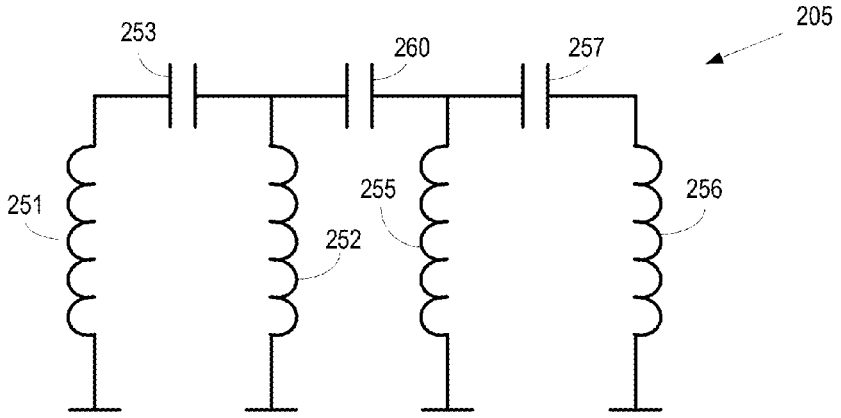

FIG. 2 depicts a quasi-capacitively coupled cavity resonator pair 200 and a corresponding effective electrical equivalent circuit 205 according to some embodiments. The coupled cavity resonator pair 200 includes a first cavity resonator 210 and a second cavity resonator 215 that are formed of a cover plate 220, a base plate 225, and a common wall 230. Each of the cavity resonators 210, 215 includes a corresponding loading element 235, 240 that can be adjusted (as indicated by the dotted lines) to change the capacitive loading in the cavity resonators 210, 215, thereby changing the resonator frequency of the cavity resonators 210, 215 and the coupled cavity resonator pair 200. Some embodiments of the coupled cavity resonator pair 200 may be implemented as the cross-coupled cavity resonators 102, 105 in the filter 100 shown in FIG. 1.

The cavity resonators 210, 215 are coupled by a quasi-capacitive coupling loop 245 that is formed of a conducting material. Some embodiments of the coupling loop 245 are symmetric about an axis 250 that is parallel to the common wall 230. The axis 250 may correspond to a rotational axis of the coupling loop 245. Portions of the coupling loop 245 define areas in the cavity resonators 210, 215. For example, an upper portion of the coupling loop 245 partially encompasses a first area in the cavity resonator 210 that is also bounded by the axis 250 and a lower portion of the coupling loop 245 partially encompasses a second area in the cavity resonator 215 that is also bounded by the axis 250. Magnetic fields near the common wall 230 of the cavity resonators 210, 215 may project substantially into or out of the plane of FIG. 2 and the areas bounded by the coupling loop 245 are in the plane of FIG. 2. Thus, the areas bounded by the coupling loop 245 may lie in a plane that is substantially perpendicular to magnetic fields in the cavity resonators 210, 215. However, the magnetic field may not be perfectly perpendicular to the plane of FIG. 2 and may include components that are in the plane of FIG. 2. The term "substantially perpendicular" is intended to encompass these variations in the direction of the magnetic field near the common wall 230 of the cavity resonators 210, 215.

Magnetic fields produced by electromagnetic waves in the cavity resonators 210, 215 may produce an inductive current in the coupling loop 245. For example, introducing radiofrequency signals into the cavity resonator 210 produces time varying magnetic fields in the upper portion of the coupling loop 245 that lies within the cavity resonator 210. The inductive current may flow downward (as indicated by the arrows) through the upper portion of the coupling loop 245, cross from the cavity resonator 210 into the lower portion of the coupling loop 245 in the cavity resonator 215, and flow downward through the lower portion of the coupling loop 245.

Thus, current flows in substantially the same direction in the upper portion and the lower portion of the coupling loop 245.

The current direction through the coupling loop 245 determines the phase angle of the coupling between electromagnetic waves in the cavity resonators 210, 215. Since the direction of the current in the upper portion and the lower portion of the coupling loop 245 is substantially the same, the phase of electromagnetic waves is inverted by traversing the coupling loop 245 between the cavity resonators 210, 215 relative to the phase produced by traditional U-shaped coupling loops. Coupling exists only between the vertical elements of the coupling loop 245 and the adjacent cavity resonators 210, 215 because of the axisymmetric magnetic field direction about the loading elements 235, 240 within the cavity resonators 210, 215. Consequently, a quasi-capacitive coupling is achieved at a location where only inductive coupling is possible.

The coupled cavity resonator pair 200 may be represented by the effective electrical equivalent circuit 205. For example, the cavity resonator 210 may be represented by inductances 251, 252 and capacitor 253. The cavity resonator 215 may be represented by inductances 255, 256 and capacitor 257. The quasi-capacitive coupling between the cavity resonators 210, 215 formed by the coupling loop 245 may then be represented by the capacitor 260. The strength of the quasi-capacitive coupling may be determined by the areas bounded by the coupling loop 245 in the cavity resonators 210, 215.

Figure 3:
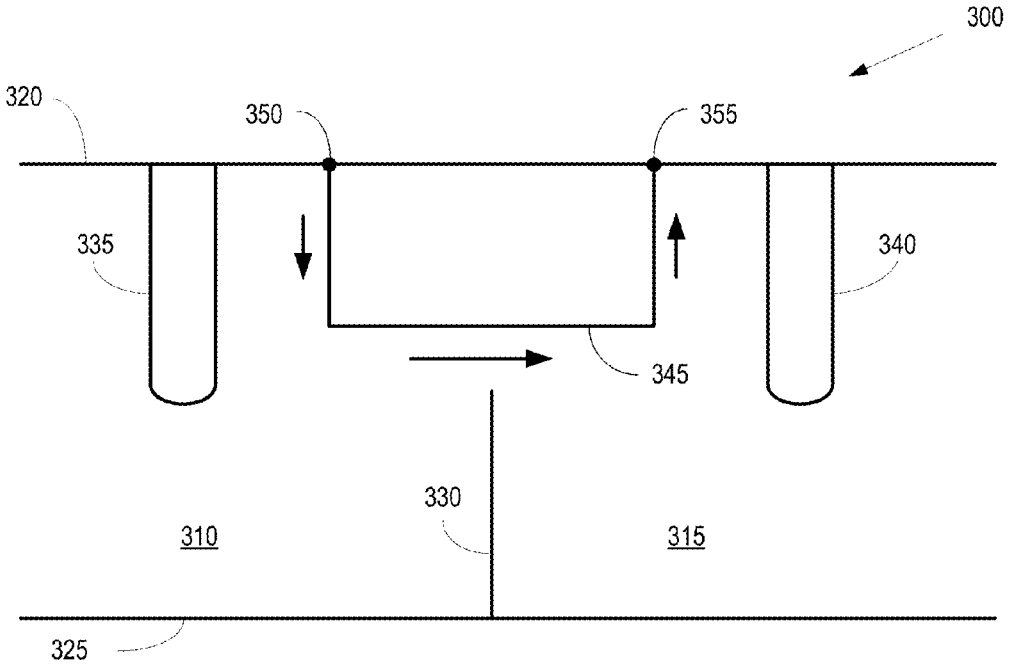
FIG. 3 depicts an inductively coupled cavity resonator pair and a corresponding effective electrical equivalent circuit according to some embodiments.
Figure 3:
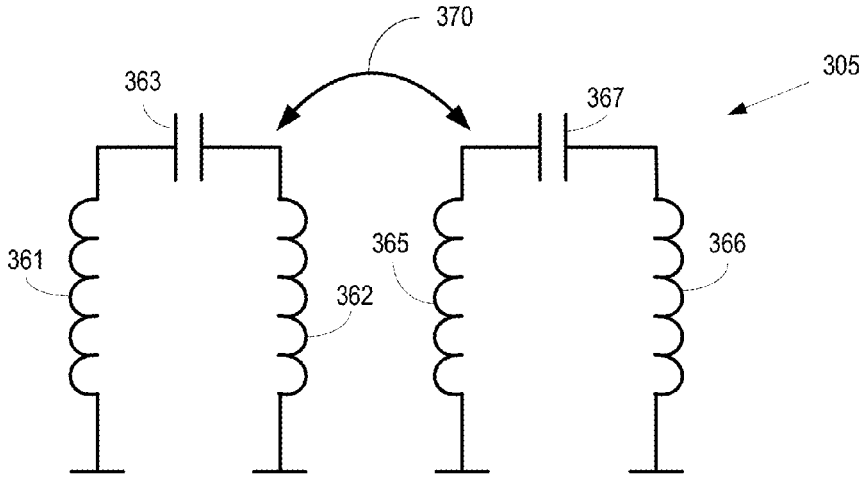

FIG. 3 depicts an inductively coupled cavity resonator pair 300 and a corresponding effective electrical equivalent circuit 305 according to some embodiments. The cavity resonator pair 300 is shown for purposes of comparison with the quasi-capacitive cavity resonator pair 200 shown in FIG. 2. The coupled cavity resonator pair 300 includes a first cavity resonator 310 and a second cavity resonator 315 that are formed of a cover plate 320, a base plate 325, and a common wall 330. Each of the cavity resonators 310, 315 includes a corresponding loading element 335, 340. The cavity resonators 310, 315 are coupled by an inductive coupling loop 345 that is formed of a conducting material. Some embodiments of the inductive coupling loop 345 may be referred to as a "U-shaped" coupling loop because the inductive coupling loop 345 resembles the shape of the letter U.

The inductive coupling loop 345 differs from the quasi-capacitive coupling loop 245 shown in FIG. 2 because both ends of the inductive coupling loop 345 connect to the cover plate at locking points 350, 355. These differences have at least two consequences. First, inductive currents in the first cavity resonator 310 (indicated by the arrows) travel in the opposite direction to currents in the second cavity resonator 315 so that the phase of the electromagnetic waves produced in the cavity resonator 315 is inverted relative to the phase of the electromagnetic waves produced in the cavity resonator 215 by the quasi-capacitive coupling loop 245 shown in FIG. 2. Second, adjusting the coupling constant of the inductive coupling loop 345 requires loosening or decoupling the inductive coupling loop 345 at the locking points 350, 355 to reposition the coupling loop 345.

The coupled cavity resonator pair 300 may be represented by the effective electrical equivalence circuit 305. For example, the cavity resonator 310 may be represented by inductances 361, 362 and capacitor 363. The cavity resonator 315 may be represented by inductances 365, 366 and capacitor 367. The inductive coupling between the cavity resonators 310, 315 is represented by the double-headed arrow 370 indicating a mutual inductance between inductances 362 and 365.

Figure 4:
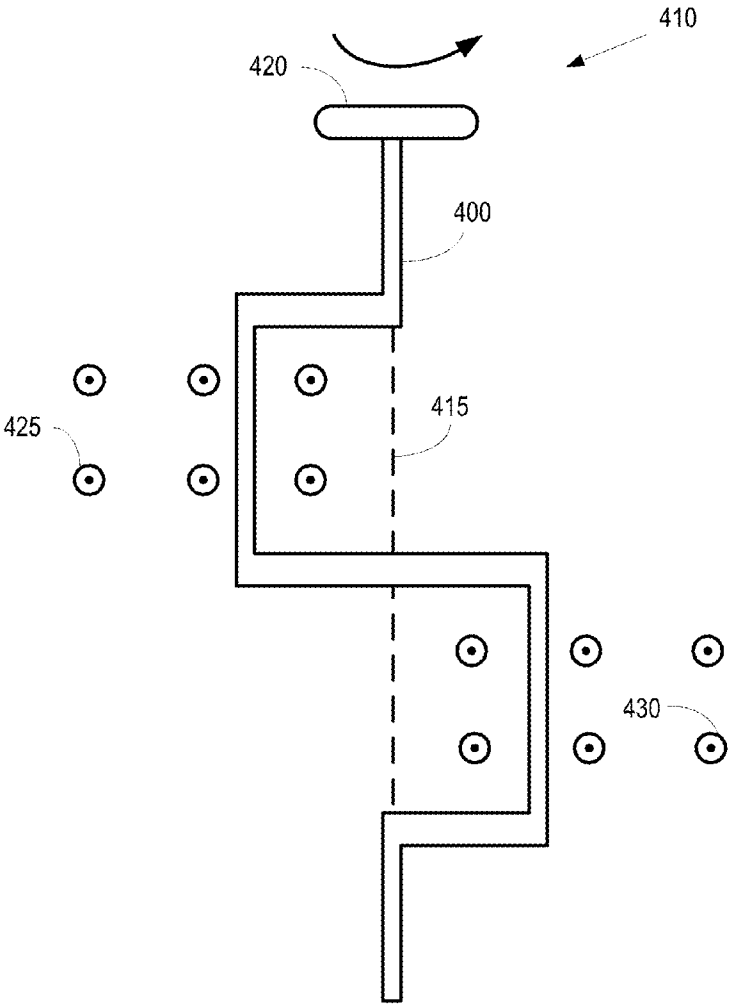
FIG. 4 is a diagram of a coupling loop that can be rotated from a first orientation to a second orientation according to some embodiments.
Figure 4:
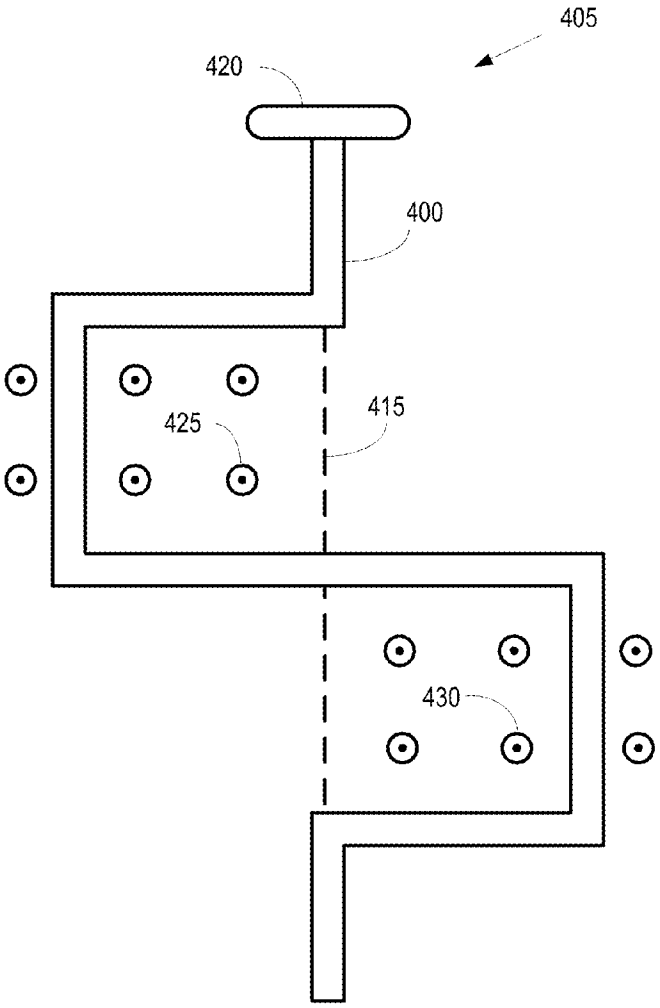

FIG. 4 is a diagram of a coupling loop 400 that can be rotated from a first orientation 405 to a second orientation 410 according to some embodiments. The coupling loop 400 can be rotated about an axis 415 by external turning a knob 420 that is connected to the coupling loop 400. Some embodiments of the knob 420 may be a circular or oval structure that can be turned manually, e.g., by a person that is configuring the coupling loop 400. The knob 420 may also be representative of other devices that can be used to rotate the coupling loop 400 about the axis 415, e.g., electrical or mechanical devices that can be activated by a person or an automated or robotic control system. The coupling loop 400 may be deployed in an aperture between two cavity resonators so that an upper portion of the coupling loop 400 protrudes into one of the cavity resonators and a lower portion of the coupling loop protrudes into another one of the cavity resonators. Some embodiments of the coupling loop 400 may be used to implement the coupling loop 245 shown in FIG. 2.

An area defined by the upper portion of the coupling loop 400 is in a plane that is substantially perpendicular to a first magnetic field, which may correspond to the magnetic field produced when a radiofrequency signal is introduced into a cavity resonator. The first magnetic field is directed out of the plane of FIG. 4, as indicated by the dotted circles 425 (only one indicated by a reference numeral in the interest of clarity). The magnetic field 425 generates an inductive current in the coupling loop 400 and the amount of current is determined in part by the area defined by the upper portion of the coupling loop 400. This current travels in the same direction in the lower portion of the coupling loop 400 and therefore generates a magnetic field 430 that is also substantially out of the plane of FIG. 4 in the coupled cavity resonator, as indicated by the dotted circles 430 (only one indicated by a reference numeral in the interest of clarity). The coupling constant produced by the coupling loop 400 in the orientation 405 is therefore determined by the areas defined by the upper and lower portions of the coupling loop 400 in a plane that is substantially perpendicular to the magnetic field 425, 430.

In the orientation 410, which is rotated relative to the orientation 405, the areas defined by the upper and lower portions of the coupling loop 400 in the plane substantially perpendicular to the magnetic field 425, 430 are reduced relative to the areas defined by the upper and lower portions of the coupling loop 400 in the orientation 405. Consequently, the inductive current in the coupling loop 400 in the orientation 410 is reduced relative to the inductive current in the coupling loop 400 in the orientation 405. The coupling constant produced by the coupling loop 400 in the orientation 410 is also reduced relative to the coupling constant in the orientation 410. The variation in the coupling constant created by rotating the coupling loop 400 about the axis 415 can be used to adjust the coupling constant, perhaps in coordination with adjusting the frequency response of the cavity resonators, to adjust the transfer function of filters including the cavity resonators and the coupling loop 400.

Figure 5:
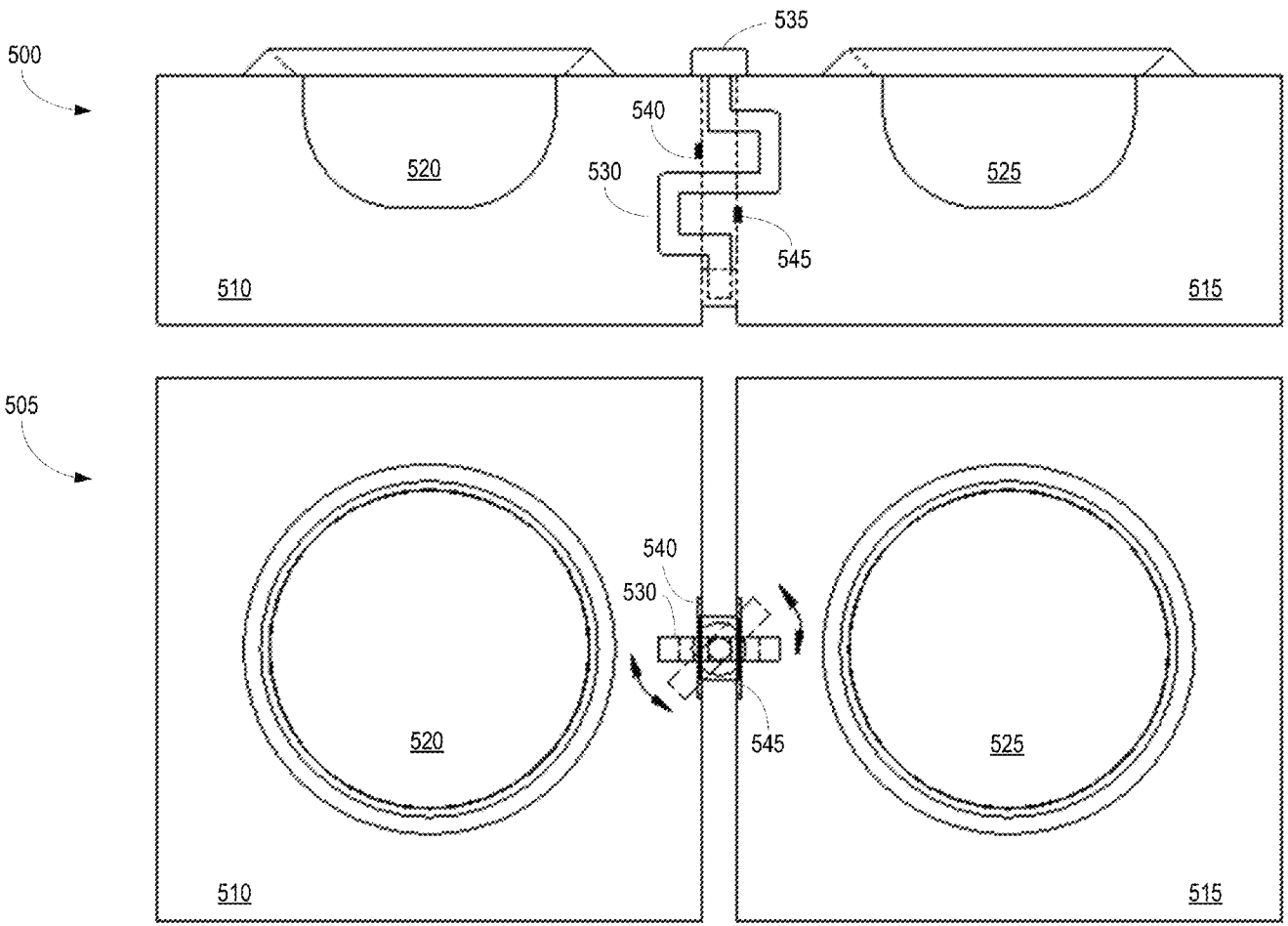
FIG. 5 depicts a side view and a top view of a pair of coupled cavity resonators with variable loading according to some embodiments.

FIG. 5 depicts a side view 500 and a top view 505 of a pair of coupled cavity resonators 510, 515 according to some embodiments. Each of the cavity resonators 510, 515 includes a loading element 520, 525, which may be adjustable, and a coupling loop 530 that may be rotatably adjusted about an axis using a knob 535. Some embodiments of the cavity resonators 510, 515 or the coupling loop 530 may be implemented in the filter 100 shown in FIG. 1.

The coupling loop 530 is deployed in an aperture between the cavity resonators 510, 515. In some embodiments, one or more conducting bars 540, 545 may be positioned horizontally across the aperture to electrically connect the sides of the aperture wall at one or more vertical locations. For example, the conducting bars 540, 545 may be positioned horizontally across the aperture on different sides of the aperture and in positions that are displaced with respect to each other along a direction parallel to the axis of the coupling loop 530. The conducting bars 540, 545 may at least partially suppress magnetic coupling between the cavity resonators 510, 515. In some embodiments, the size of the aperture, the thickness of the common wall between the cavity resonators 510, 515, or the size or position of the conducting bars 540, 545 may limit the maximum rotation angle of the coupling loop 530.

Figure 6:
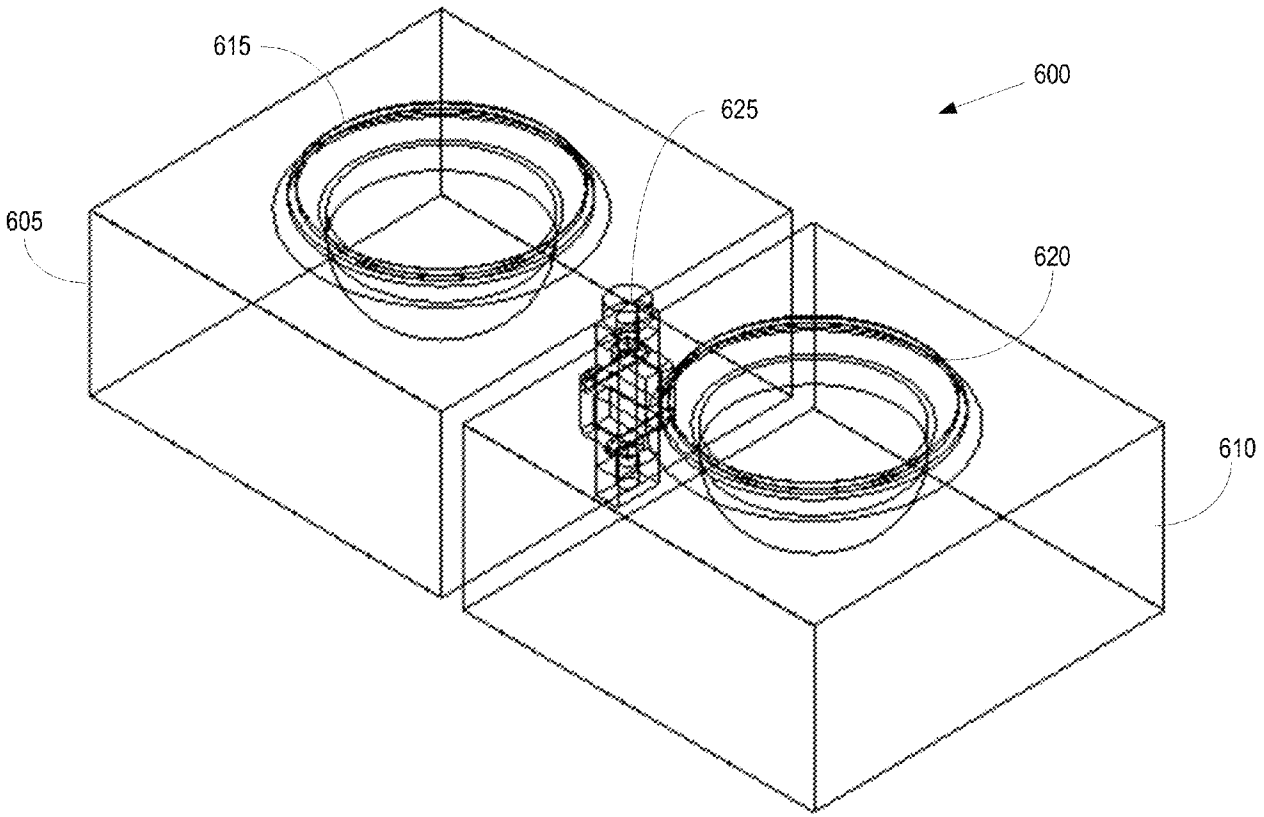
FIG. 6 depicts a three-dimensional view of a pair of coupled cavity resonators according to some embodiments.

FIG. 6 depicts a three-dimensional view 600 of a pair of coupled cavity resonators 605, 610 according to some embodiments. Each of the cavity resonators 605, 610 includes a loading element 615, 620, which may be adjustable. A coupling loop 625 is deployed in an aperture between the cavity resonators 605, 610 and may be rotatably adjusted about an axis. Some embodiments of the cavity resonators 605, 610 or the coupling loop 625 may be implemented in the filter 100 shown in FIG. 1.

Figure 7:
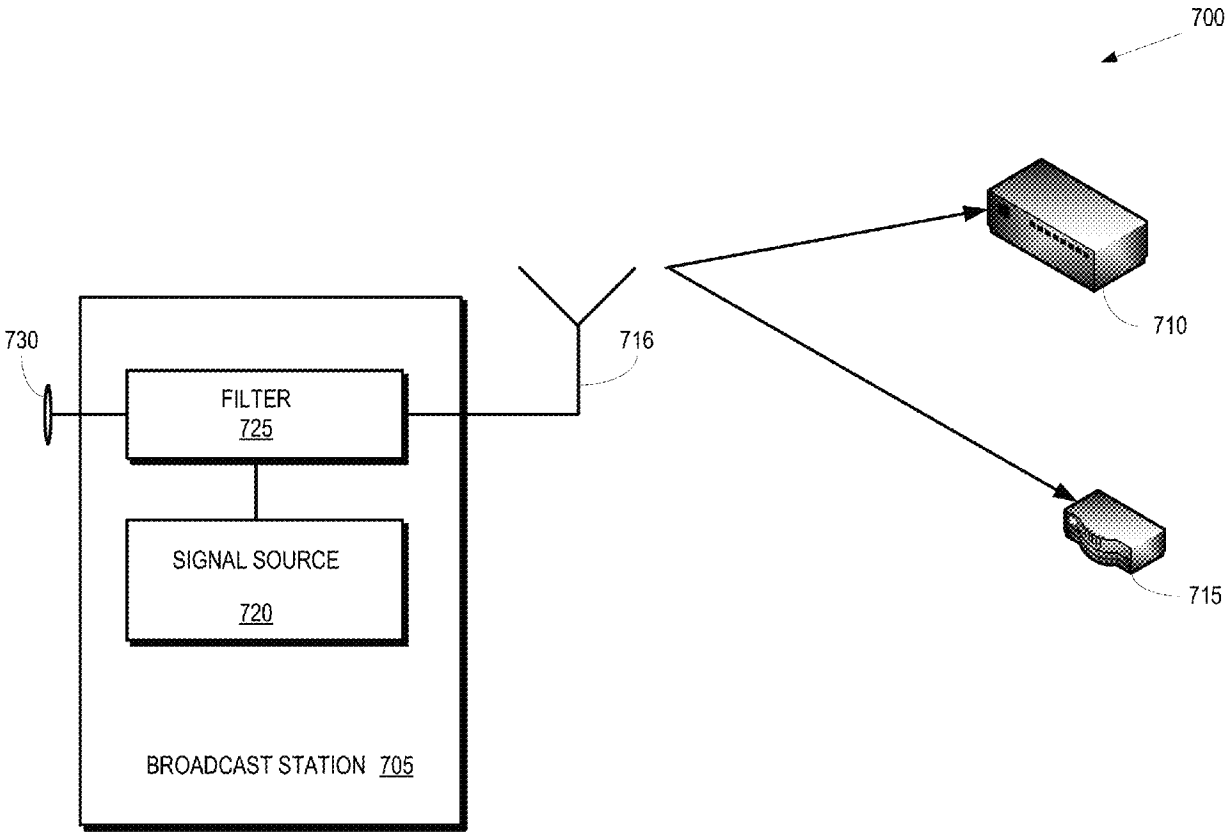
FIG. 7 is a block diagram of a wireless communication system according to some embodiments.

FIG. 7 is a block diagram of a wireless communication system 700 according to some embodiments. The wireless communication system 700 includes one or more broadcast stations 705 for broadcasting radiofrequency signals to one or more associated user equipment 710, 715. Some embodiments of the broadcast station 705 may implement one or more high-power transmitters that can operate at powers above a few kilowatts, such as powers in the range of 10-50 kW. For example, the broadcast station 705 may be configured to broadcast high-power signals towards a television receiver 710 or a television set-top box 715 using one or more antennas 716, as indicated by the arrows. Some embodiments of the broadcast station 705 may also be adjusted to broadcast radiofrequency signals in different frequency bands. For example, the broadcast station 705 may be adjusted to selectively broadcast radiofrequency signals at different center frequencies and in different frequency bands within a range from 400 MHz to 900 MHz. Television broadcasts may be performed using frequencies in the range from 470 MHz to 860 MHz minus Delta. The quantity "Delta" is country-dependent. For example in the U.S., the upper end of the UHF TV band may be as low as 680 MHz. Other embodiments may be implemented in all existing broadcast and cellular frequency bands.

The broadcast station 605 includes a signal source 720 that can be used to generate radiofrequency signals for transmission toward user equipment 710, 715. The signals generated by the signal source 720 may be provided to a filter 725 to filter unwanted spectral components that are outside of a frequency band, which may be defined by a center frequency and a bandwidth of a selectivity mask. The filter 725 may be an adjustable filter formed of a plurality of cavity resonators such as the filter 100 shown in FIG. 1. Some embodiments of the filter 725 may be adjusted using a knob 730 that is external to a filter body or a housing of the broadcast station 705. As discussed herein, the knob 730 may refer to an actual structure that can be turned by a person or the knob 730 may represent mechanical or electrical devices that can be activated by a person or an automated or robotic control system.

Figure 8:
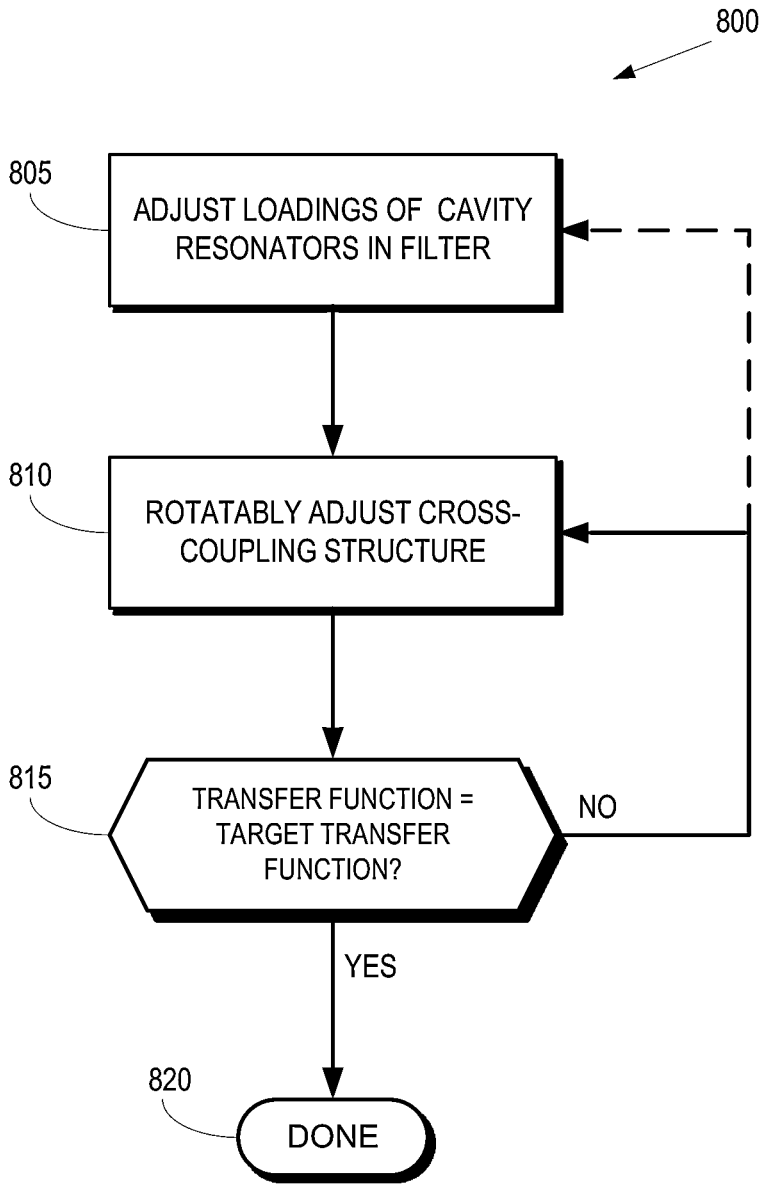
FIG. 8 is a flow diagram of a method for adjusting a transfer function of a filter formed of a plurality of cavity resonators according to some embodiments.

FIG. 8 is a flow diagram of a method 800 for adjusting a transfer function of a filter formed of a plurality of cavity resonators according to some embodiments. The method 700 may be implemented to adjust or modify a transfer function of the filter 100 shown in FIG. 1 or the filter 625 shown in FIG. 6. The filter transfer function may depend on some or all of the cavity resonator frequencies or bandwidths, the input or output couplings or ports, direct couplings between the resonators, or cross-couplings between the resonators. Embodiments of the method 800 illustrated in FIG. 8 assume that the filter transfer function may be adjusted by coordinated adjustment of cavity resonator loadings and one or more coupling and cross-coupling structures. However, other embodiments may include adjustments of other properties of the filter that affect the filter transfer function. Embodiment to the method 800 may be implemented in a controller or a computer and may be used to control a motor actuator.

At block 805, loadings of the cavity resonators in the filter are adjusted to modify the resonant frequency of one or more of the cavity resonators. At block 810, a cross-coupling structure that provides a quasi-capacitive coupling between two or more of the cavity resonators is rotatably adjusted in coordination with the adjustments in the loadings of the cavity resonators to modify the transfer function of the filter. At decision block 815, the transfer function of the filter is measured and compared to a target transfer function. If the target transfer function and the measured transfer function are the same (within a given tolerance), the method 800 finishes at block 820. If the target transfer function does not match the measured transfer function within the given tolerance, the cross-coupling structure is again rotatably adjusted at block 810. In some embodiments, the loadings of the cavity resonators may also be adjusted to bring the measured transfer function in agreement with the target transfer function. For example, it may be necessary to fine-tune resonators that may have been detuned by adjusting the cross-coupling structure at block 815 because there is usually strong interaction between coupling adjustment and resonator frequency. The resonators adjacent to the coupling may therefore detune slightly when the coupling is changed. This tuning offset can then be corrected at block 805.

In some embodiments, certain aspects of the techniques described above may be implemented by one or more processors of a processing system executing software. The software comprises one or more sets of executable instructions stored or otherwise tangibly embodied on a non-transitory computer readable storage medium. The software can include the instructions and certain data that, when executed by the one or more processors, manipulate the one or more processors to perform one or more aspects of the techniques described above. The non-transitory computer readable storage medium can include, but is not limited to, optical media (e.g., compact disc (CD), digital versatile disc (DVD), Blu-Ray disc), magnetic media (e.g., floppy disc, magnetic tape, or magnetic hard drive), volatile memory (e.g., random access memory (RAM) or cache), non-volatile memory (e.g., read-only memory (ROM) or Flash memory), or microelectromechanical systems (MEMS)-based storage media. The computer readable storage medium may be embedded in the computing system (e.g., system RAM or ROM), fixedly attached to the computing system (e.g., a magnetic hard drive), removably attached to the computing system (e.g., an optical disc or Universal Serial Bus (USB)-based Flash memory), or coupled to the computer system via a wired or wireless network (e.g., network accessible storage (NAS)). The executable instructions stored on the non-transitory computer readable storage medium may be in source code, assembly language code, object code, or other instruction format that is interpreted or otherwise executable by one or more processors.

Note that not all of the activities or elements described above in the general description are required, that a portion of a specific activity or device may not be required, and that one or more further activities may be performed, or elements included, in addition to those described. Still further, the order in which activities are listed are not necessarily the order in which they are performed. Also, the concepts have been described with reference to specific embodiments. However, one of ordinary skill in the art appreciates that various modifications and changes can be made without departing from the scope of the present disclosure as set forth in the claims below. Accordingly, the specification and figures are to be regarded in an illustrative rather than a restrictive sense, and all such modifications are intended to be included within the scope of the present disclosure.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims. Moreover, the particular embodiments disclosed above are illustrative only, as the disclosed subject matter may be modified and practiced in different but equivalent manners apparent to those skilled in the art having the benefit of the teachings herein. No limitations are intended to the details of construction or design herein shown, other than as described in the claims below. It is therefore evident that the particular embodiments disclosed above may be altered or modified and all such variations are considered within the scope of the disclosed subject matter. Accordingly, the protection sought herein is as set forth in the claims below.

What is claimed is:

1. An apparatus, comprising:

a conductor having a first portion to define a first area in a plane that is substantially perpendicular to a first magnetic field direction in a first cavity resonator an a second portion to define a second area in a plane that is substantially perpendicular to a second magnetic field direction in a second cavity resonator such that inductive current generated in the first portion flows in substantially the same direction as current in the second portion, wherein the first area and the second area determine a coupling constant between electromagnetic fields in the first cavity resonator and the second cavity resonator, and wherein the conductor is rotatably adjustable about an axis.

2. The apparatus of claim 1, wherein the conductor is rotatably adjustable about the axis to modify the first area and the second area by changing the relative orientation of the conductor and the first and second magnetic fields directions.

3. The apparatus of claim 2, further comprising:

a knob coupled to the conductor to rotatably adjust the conductor about the axis.

4. An apparatus, comprising:

a first cavity resonator;

a second cavity resonator; and a conductor coupled between the first cavity resonator and the second cavity resonator, wherein a first portion of the conductor defines a first area in a lane that is substantially perpendicular to a first magnetic field direction in the first cavity resonator and a second portion of the conductor defines a second area in a plane that is substantially perpendicular to a second magnetic field direction in the second cavity resonator such that inductive current generated in the first portion flows in substantially the same direction as current in the second portion of the conductor, wherein the first area and the second area determine a coupling constant between electromagnetic fields in the first cavity resonator and the second cavity resonator, wherein a phase of an electromagnetic wave in the first cavity resonator is inverted when transmitted to the second cavity resonator by the conductor relative to a traditional U-shaped conductor solution, and wherein the conductor is rotatably adjustable about an axis.

5. The apparatus of claim 4, wherein the conductor is rotatably adjustable about the axis to modify the first area and the second area by changing the relative orientation of the conductor, the first magnetic field, and the second magnetic field.

6. The apparatus of claim 5, wherein the first cavity resonator comprises a first adjustable loading element and the second cavity resonator comprises a second adjustable loading element, and wherein the conductor is rotatably adjustable in coordination with adjustments to at least one of the first adjustable loading element or the second adjustable loading element to modify a transfer function of the first cavity resonator and the second cavity resonator.

7. An apparatus, comprising:

a first cavity resonator;

a second cavity resonator;

a rotatable conductor coupled between the first cavity resonator and the second cavity resonator, wherein a first portion of the rotatable conductor defines a first area in a plane that is substantially perpendicular to a first magnetic field direction in the first cavity resonator and a second portion of the rotatable conductor defines a second area in a plane that is substantially perpendicular to a second magnetic field direction in the second cavity resonator such that inductive current generated in the first portion flows in substantially the same direction as current in the second portion of the rotatable conductor;

an aperture between the first cavity resonator and the second cavity resonator, wherein the conductor is deployed in the aperture, and at least one conducting bar deployed in the aperture perpendicular to an axis of the rotatable conductor.

8. The apparatus of claim 7, wherein the at least one conducting bar comprises two conducting bars deployed in the aperture perpendicular to the axis, wherein the two conducting bars are displaced from each other along a direction parallel to the axis.

9. The apparatus of claim 7, further comprising:

third, fourth, fifth, and sixth cavity resonators, wherein the first, second, third, fourth, fifth, and sixth cavity resonators are directly coupled, and wherein at least two non-adjacent cavity resonators are cross coupled by the conductor.

10. A base station, comprising:

a signal source;

a filter comprising a plurality of cavity resonators, wherein at least two of the plurality of cavity resonators are coupled by a conductor having a first portion that defines a first area in a plane that is substantially perpendicular to a first magnetic field direction in a first one of the at least two cavity resonators and a second portion that defines a second area in a plane that is substantially perpendicular to a second magnetic field direction in a second one of the at least two cavity resonators such that inductive current generated in the first portion flows in substantially the same direction as current in the second portion; and a knob external to a housing of the base station, wherein the knob is rotatable to adjust the conductor about an axis to modify the first area and the second area by changing the relative orientation of the conductor and the first and second magnetic field directions.

11. The base station of claim 10, wherein a transfer function of the filter can be adjusted to selectively filter signals within a range from 400 MHz to 900 MHz.

12. The base station of claim 10, wherein the signal source generates broadcast signals at a power in the range of 10 kW to 50 kW.

* * * * *